United States Patent [19]

Takeda et al.

[11] Patent Number: 4,904,990

[45] Date of Patent: Feb. 27, 1990

[54] DISPLAY CONTROL DEVICE

[75] Inventors: Hiroshi Takeda, Koganei; Shigeaki Yoshida, Sayama; Koyo Katsura, Hitachi, all of Japan

[73] Assignee: Hitachi, Ltd., Tokyo, Japan

[21] Appl. No.: 144,279

[22] Filed: Jan. 15, 1988

Related U.S. Application Data

[62] Division of Ser. No. 686,594, Dec. 26, 1984, Pat. No. 4,720,708.

[30] Foreign Application Priority Data

Dec. 26, 1983 [JP] Japan ..... 58-243802

[51] Int. Cl.[4] ..... G09G 3/00

[52] U.S. Cl. ..... 340/814; 375/107; 340/745

[58] Field of Search ..... 375/107; 340/721, 723, 340/735, 747, 744, 814, 745, 799; 370/100-103; 358/152, 153

[56] References Cited

U.S. PATENT DOCUMENTS

| | | | |
|---|---|---|---|
| 3,898,377 | 8/1975 | Fairbairn et al. | 358/153 |
| 4,425,581 | 1/1984 | Schweppe et al. | 340/744 |
| 4,450,442 | 5/1984 | Tanaka | 340/721 |
| 4,455,554 | 6/1984 | Demke | 340/721 |
| 4,484,187 | 11/1984 | Brown et al. | 340/747 |
| 4,491,832 | 1/1985 | Tanaka | 340/735 |
| 4,495,594 | 1/1985 | Eggebrecht et al. | 340/723 |
| 4,720,708 | 1/1988 | Takeda et al. | 340/814 |

*Primary Examiner*—Gerald Brigance
*Assistant Examiner*—Richard Hjerpe
*Attorney, Agent, or Firm*—Antonelli, Terry & Wands

[57] ABSTRACT

A CRT (cathode ray tube) controller for controlling one CRT device in an interlace mode has a synchronizing circuit of bi-directional construction, in order to make possible synchronous operation of the CRT controller with other circuits (other CRT controllers or a TV system). When the CRTC is used as a master circuit of a CRT display system, a synchronizing signal is derived from the synchronizing circuit in synchronization with a count signal of a vertical scanning counter and an output of an interlace controller of the CRTC, and is supplied to a synchronizing terminal of the other CRTCs. Scanning counters and a flip-flop for controlling an interlace operation of the other CRTCs are reset to their initial state in synchronization with the synchronizing signal. When the CRTC is used as a slave circuit, scanning counters and a flip-flop of the CRTC are reset to their initial state in synchronization with the external synchronizing signal.

9 Claims, 5 Drawing Sheets

DISPLAY CONTROL DEVICE

This is a divisional application of Ser. No. 686,594, filed Dec. 26, 1984, now U.S. Pat. No. 4,720,708 (1-19-88).

BACKGROUND OF THE INVENTION

This invention relates to control of the generation of data displays, and in particular to a technique which is especially effective when applied to a control device employed for the display of digital image data, for example, in a cathode ray tube (CRT) display device.

In order to cause a CRT display device to display image data which has been previously written in a memory by a computer or the like, for example, it is necessary to access the memory to read out this image data and to prepare synchronizing signals corresponding to the access period. If a sequence of these processing operations are assigned, for instance, to a CPU (central processing unit) of a computer system, the tasks of the CPU are increased, and thus the entire throughput thereof is greatly reduced. Display control devices which are exclusively used for executing these processing operations separately, namely the control of the memory and the preparation of synchronizing signals, have been proposed previously by the inventors and are embodied in display control device Models HD6845, HD68A45 and HD6845S of Hitachi, Ltd.

These display control devices are also called CRTCs. Each of these devices is provided with a scanning counter which is incremented at a period based on the timing of access to the memory, whose count is circulated periodically, and which has functions such that the memory can be accessed according to address data prepared on the basis of the count of the scanning counter and a horizontal synchronizing signal and a vertical synchronizing signal can each be generated based on the count of the scanning counter, so that image data stored in the memory can be displayed on a display device of a scanning system in which an image display screen is formed of horizontal scanning lines forming successive frames. Such a CRTC is formed of a semiconductor integrated circuit, and it is typically connected as a peripheral device to a system bus of a CPU, for example, when in use. This relieves the CPU of the task of display control, in terms of both hardware and software, and thus the throughput of the entire system can be increased.

The present inventors have examined a method in which, when a plurality of these CRTCs are used, image data stored in memories controlled by each of the CRTCs is superposed and displayed on one image display screen. The inventors have found, however, that it is insufficient to simply apply the same basic clock to each CRTC to provide a superposed display on one image screen. In a CRTC, horizontal and vertical synchronizing signals are generated to control the CRT display device. These synchronizing signals are generated by the scanning counter which counts a basic clock provided from the external equipment. Here, when a plurality of CRTCs each generate identical synchronizing signals based on the same basic clock, the phases of these synchronizing signals do not always agree with each other. For example, once the count of the scanning counter in any one of the CRTCs differs from those in the other CRTCs, this difference appears as a phase difference between the synchronizing signals, and this state is not automatically corrected, but remains. As a result, the positional relationships of the superposed images, or the synchronization thereof, is disrupted.

SUMMARY OF THE INVENTION

An object of the present invention is to provide a display technique which enables a superposed display of a plurality of image data items controlled by each of a plurality of CRTCs, within one image display screen, with the prescribed mutual positional relationships thereof maintained.

An additional object of the present invention is to provide a display technique which enables the superposed display on one image display screen of image data displayed by a display system, such as a television system, which has a separate synchronizing signal system, and image data controlled by a CRTC, with a prescribed mutual positional relationship thereof maintained.

The objects of the present invention are achieved by a method in which the count of a scanning counter provided for generating synchronizing signals in a CRTC is periodically initialized forcibly to a prescribed value by an external signal, so that any phase difference between the synchronizing signals in the CRTC and external synchronizing signals is modified periodically or whenever appropriate, and thus a plurality of image data can be displayed in superposed relationship with the mutual positional relationships thereof maintained.

DETAILED DESCRIPTION OF THE PREFERRED EMBODIMENTS

Typical embodiments of the present invention will be described hereunder with reference to the drawings, in which identical or equivalent elements are denoted by the same symbols.

Figure 1:
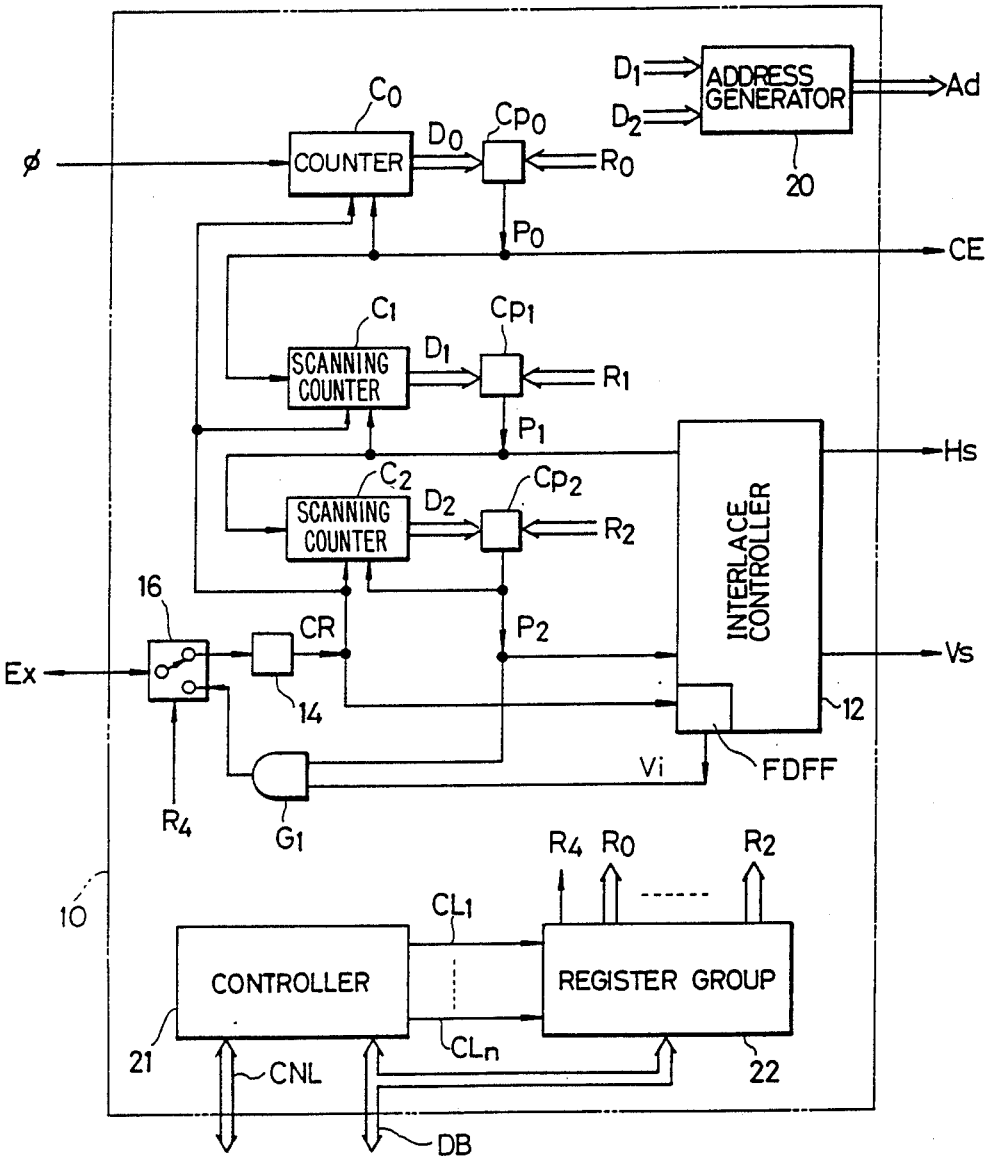
FIG. 1 is a schematic diagram of one embodiment of a display control device of the present invention.

FIG. 1 shows one embodiment of a display control device in accordance with the present invention.

The display control device 10, called a CRTC, is provided with scanning counters $C_1$ and $C_2$ which are incremented at a rate based on the timing of access to a memory containing the data to be displayed, and the counts of these counters are circulated (reset or initialized) periodically so that image data stored in the memory can be displayed on the screen of a display device having a scanning system in which an image display is formed of horizontal scanning lines forming successive frames. The memory is accessed by address data Ad generated by an address generator 20 on the basis of count content $D_1$ and $D_2$ of the scanning counters $C_1$ and $C_2$, respectively. Simultaneously, a horizontal synchronizing signal Hs and a vertical synchronizing signal Vs are also generated at the output of an interlace controller 12 in response to signals $P_1$ and $P_2$ which are produced on the basis of the counts $D_1$ and $D_2$ of the scanning counters $C_1$ and $C_2$, respectively, as will be described in more detail hereinafter. The counts of the scanning counters $C_1$ and $C_2$ may be initialized to prescribed values by an external signal Ex.

Here, the scanning counters $C_1$ and $C_2$ are comprised of a first scanning counter $C_1$ providing an output $D_1$ for synchronizing the horizontal scanning lines and a second scanning counter $C_2$ providing $D_2$ for synchronizing the successive frames, and these counters $C_1$ and $C_2$ may be initialized together by the external signal Ex so that their counts have prescribed values at the start of each display frame, for example.

The display control device 10 is formed of a semiconductor integrated circuit (LSI circuit), and is constructed so that it may be connected to a system bus of a CPU, for instance, as a peripheral device as will be described in more detail later with reference to FIG. 3. A CRT display device of an interlace (jump) scanning system may be employed as the display device. The memory is a so-called refresh memory or a video RAM (VRAM), and a RAM (random-access memory) is generally used therefor.

A more detailed description will be made hereunder with reference to FIG. 1. In addition to the first and second scanning counters $C_1$ and $C_2$, the device shown in this figure is provided with an access timing detection counter $C_0$, data comparator circuits $CP_0$, $CP_1$, and $CP_2$, the address generation circuit 20, an interlace control circuit 12, a pulse cut-out circuit 14, a terminal-switching circuit 16, and an AND gate $G_1$. A group of control registers 22 which can be written from externally are provided, and various operating modes of the display control device 10 are set or selected according to data written into this group of registers 22 under control of the CPU via controller 21. Comparison reference values $R_1$ and $R_2$ of the data comparator circuits $CP_1$ and $CP_2$ and a control signal $R_4$ used for setting the switching position of the terminal-switching circuit 16 are set by this group of control registers 22.

The controller 21 has an address register (not shown) for selecting one register of the register group 22, input control terminals CNL for receiving control signals (such as a read/write signal, a chip select signal, and a register select signal for selecting the address register or the register group), data input terminals DB, and output terminals $CL_1$ to $CL_2$.

The register group has output terminals $R_0$ to $R_4$, plural registers corresponding to the output terminals $R_0$ to $R_4$, a bi-directional data terminal connected to the input terminals DB and control signal inputting terminals connected to the output terminals $CL_1$ to CLn of the controller 21.

In a CRT display system, the input control terminals CNL are connected to an address bus line of a CPU system, and the input terminals DB are connected to a data bus line of the same. When the control signals at the control terminals CNL are directed to a writing state of the address register (chip select signal $\overline{CS}$ at the select level (e.g. low), register select signal RS at the select level of the address register (e.g. low), and read/-write signal R/W at the writing level (e.g. low)), the address register is selected. Thus, the register selection data for selecting one register of the register group 22 is written into the address register through the input terminals DB. After this operation, the control signals are changed to a writing state of the register group 22 (register select signal RS is changed to a select level of the register group 22 (e.g. high)), then one register of the register group is selected in accordance with the content of the address register in the controller 21. Accordingly, control data is written into the designated register of the register group 22 through the input terminals DB. Control data $R_0$ to $R_4$ is written into each register of the group 22 by repetition of this operation.

Display sizes (horizontal size and vertical size) of the display panel are determined by the data $R_1$ and $R_2$ since the pulse period of the pulse signal $P_1$ and the pulse period of the pulse signal $P_2$ are determined by the data $R_1$ and $R_2$.

A basic clock $\phi$ is first inputted to the display control device 10. The basic clock $\phi$ is synchronized with the clock of the system to which the display control device 10 is connected, for instance. The basic clock $\phi$ acts as a count input to the access timing detection counter $C_0$. The counter $C_0$ is incremented by the basic clock $\phi$, and when a count $D_0$ thereof exceeds a comparison reference value $R_0$ of the data comparator circuit $CP_0$, it is reset so that it restarts counting from an initial value (0). In other words, the count $D_0$ circulates periodically. During each circulation period thereof, a pulse signal $P_0$ is outputted, as an access control signal CE for the memory (RAM) storing image data, to external equipment from the data comparator circuit $CP_0$. The memory is accessed thereby within each prescribed period, and one word of image element data (e.g. 8 bits or 16 bits) is read therefrom at each repeat of the access timing.

The pulse signal $P_0$ also acts as a count input to the first scanning counter $C_1$. This counter $C_1$ is designed so that it is incremented by the input pulse signal $P_0$ and, when the count $D_1$ thereof exceeds the comparison reference value $R_1$ of the data comparator circuit $CP_1$, it is reset so that it restarts counting from an initial value (0). In other words, the count $D_1$ is designed to circulate periodically. A pulse signal $P_1$ outputted from the data comparator circuit $CP_1$ during each circulation period of the count $D_1$ passes through the interlace control circuit 12 and is outputted externally as the horizontal synchronizing signal Hs for the CRT display device. In this case, the circulation period of the first scanning counter $C_1$ is made to correspond to the period at which image data for one horizontal scan is read from the memory. In other words, the comparison reference value $R_1$ is set so that the count $D_1$ of the first scanning counter $C_1$ returns to the initial value (0) when image data for one scanning line of the raster has been read therefrom.

The pulse signal $P_1$ outputted in each circulation period of the first scanning counter $C_1$ acts as a count input to the second scanning counter $C_2$. This counter $C_2$ is incremented by the input pulse signal $P_1$ and, when the count $D_2$ thereof exceeds the comparison reference value $R_2$ of the data comparator circuit $CP_2$, it is reset so that it restarts counting from an initial value (0). In other words, the second scanning counter $C_2$ is also designed so that its count $D_2$ circulates periodically. A pulse signal $P_2$ outputted from the data comparator circuit $CP_2$ during each circulation period of the count $D_2$ passes through the interlace control circuit 12 and is outputted externally as the vertical synchronizing signal Vs of the CRT display device. In this case, the circulation period of the second scanning counter $C_2$ is made to correspond to the period at which image data for one field is read from the memory. In other words, the comparison reference value $R_2$ is set so that the count $D_2$ of the second scanning counter $C_2$ returns to the initial value (0) when the imaged data corresponding to half the total number of horizontal lines constituting an image display have been read therefrom. Consequently, every time the circulation period of the second scanning counter $C_2$ is repeated twice, image data for two fields, i.e., for one frame, is read out and displayed on the CRT display device by an interlace system. When a display is produced by a CRT display device of a standard television system, for instance, approximately sixty vertical synchronizing signals Vs are generated each second, and thus thirty frames are produced per second.

The counts $D_1$ and $D_2$ of the first and second scanning counters $C_1$ and $C_2$ are applied to the address generation circuit 20. The address generation circuit produces the address data Ad for accessing the memory from these two counts $D_1$ and $D_2$. The image data stored in the memory is thereby read out in synchronization with the synchronizing signals Hs and Vs.

The interlace control circuit 12 provides scanning in which a dummy raster period is inserted into the horizontal synchronizing signals Hs, and in which the phase of the vertical synchronizing signal VS is shifted by half the horizontal scanning period for alternate fields, to provide so-called interlace scanning. For this purpose, the interlace control circuit 12 has the function of discriminating between odd-numbered field periods and even-numbered field periods. This function can be easily obtained by using a binary flip-flop FDFF which is incremented by the vertical synchronizing signal, for instance. Accordingly, an odd-numbered field (or an even-numbered field) detection signal Vi activated only during an odd-numbered field period (or an even-numbered field period), for instance, can be obtained for each frame from the interlace control circuit 12.

When the logical "and" product of the odd-numbered field detection signal Vi obtained from the interlace control circuit 12 and the pulse signal $P_2$ output during each circulation period of the second scanning counter $C_2$ is produced by the AND gate $G_1$, odd-numbered vertical synchronizing signals alone are extracted. The odd-numbered vertical synchronizing signals thus extracted are supplied, as the external synchronizing signals Ex, out of the display control device 10 through the terminal-switching circuit 16.

The above is the description of the elements outputting the external synchronizing signals Ex, but the display control circuit 10 is also constructed so that it receives synchronizing signals Ex from external equipment. These synchronizing signals Ex from external equipment are formed of odd-numbered (or even-numbered) vertical synchronizing signals alone, in the same way as the signals Ex output externally. The external synchronizing signal Ex is inputted to the pulse cut-out circuit 14 through the terminal-switching circuit 16. Within the pulse cut-out circuit 14, a narrow pulse is cut out from the external synchronizing signal Ex, and this pulse is distributed as a clear signal (reset or initialization signal) CR to the counters $C_0$, $C_1$ and $C_2$. Therefore, the counts $D_0$, $D_1$, and $D_2$ of the counters $C_0$, $C_1$, and $C_2$ are initialized (reset to 0 or an initial value) simultaneously in synchronization with the external signal Ex, when the external synchronizing signal is inputted thereto. The binary flip-flop FDFF in the interlace controller is initialized to its initial state in response to the reset signal CR derived from the pulse cut-out circuit 14. Thus, when the external synchronizing signal is inputted to the CRTC, the counters $C_0$ to $C_1$ are reset to initial state and the binary counter FDFF is reset to initial state directed to even field (or odd field).

This initialization is effected in each frame if the external synchronizing signal Ex is generated, for instance, from another display control device 10 of the same construction. Therefore, even if a count error occurs in one or more of the counters $C_0$, $C_1$, and $C_2$, it is corrected automatically when the subsequent frame period starts. Consequently, mutual synchronization of a plurality of display control devices can be secured continuously, and thus image data stored in a plurality of memories can always be superposed with the correct positional relationship for display. As a result, a plurality of images can be synthesized into a complicated image or diversified images in a simple manner and at high speed.

In this embodiment, the switching state of the terminal switching circuit 16 determines whether the synchronizing signal Ex is outputted externally or is inputted from another display control device 10. The switching state of the terminal-switching circuit 16 is controlled by a control signal $R_4$ which is set by the group of registers 22. Accordingly, whether the display control device 10 is used as a master or a slave can be determined freely by setting the group of registers 22, which is done when the device is used. On the other hand, the number of signal terminals required for the mutual synchronization of a plurality of display control devices can be reduced to one.

Figure 2:
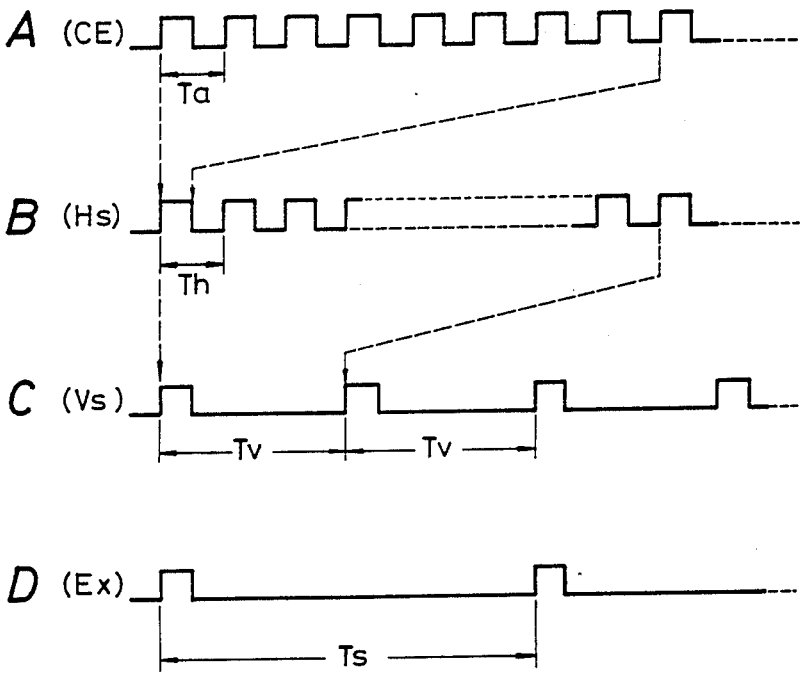
FIG. 2 is a timing chart of an example of the operation of the device of FIG. 1.

FIG. 2 is a timing chart of an example of the operation of the display control device described above. In this figure, Ta denotes the access cycle of the memory, Th denotes the horizontal scanning period, Tv denotes the field period, and Ts denotes the period of the external synchronizing signal Ex delivered within each frame.

In the foregoing explanation, reference has been made to the periodic initialization of the scanning counters by the synchronizing signal Ex. In this regard, it should be understood that such initialization could comprise a simple resetting of the scanning counters to zero, but also includes a forcing of the state of the scanning counters to a prescribed value. In the latter case, the addresses generated by one CRTC need not be the same as those generated by another CRTC in the system, which allows data stored in different locations of the same or different memories to be displayed in superposition.

Figure 3:
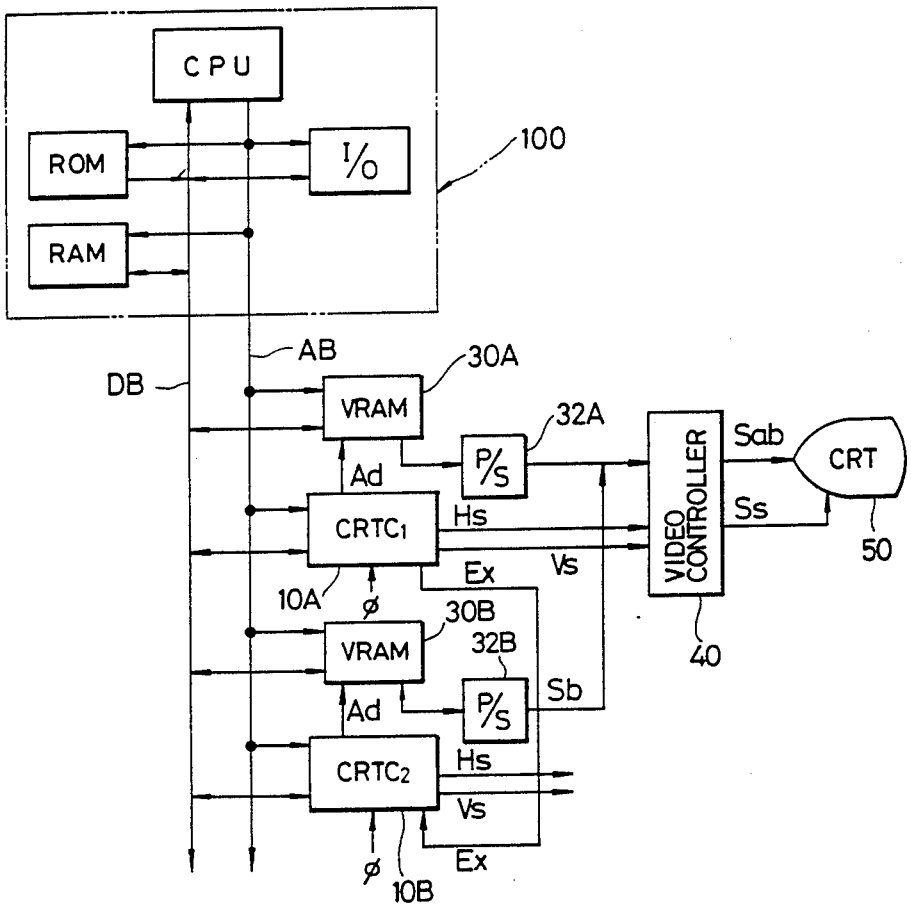
FIG. 3 is a block diagram of a system showing an example of the employment of the display control device of the present invention.

FIG. 3 shows an example of a system for employment of the display control device 10. In the example of this figure, two display control devices 10A and 10B are used. These display control devices 10A and 10B are connected to an address bus AB and data bus DB of a computer system 100, so that they can operate as peripheral devices of the computer system 100. The computer system 100 consists of, for example, a CPU, a ROM, a RAM and an I/O port.

The display control devices (CRTC1 and CRTC2) 10A and 10B control memories (RAMs) 30A and 30B storing image data, respectively. The image data read out from the memories 30A and 30B is converted into serial image signals Sa and Sb by parallel-serial conversion circuits (P/S conversion circuits) 32A and 32B, respectively, which signals are then inputted to a video controller 40, together with vertical and horizontal synchronizing signals Hs and Vs output from the display control device 10A. The video controller 40 prepares an image signal Sab and a synchronizing signal Ss for the CRT display device 50 from these input signals. Thus, the image data Sa and Sb read out from the two memories 30A and 30B is displayed in a mutually-superposed state on the CRT display device 50.

Here, one device 10A of the two display control devices 10A and 10B is set so that it outputs the synchronizing signal Ex externally within each frame period. While the other device 10B is set so that it receives, as an input, the external synchronizing signal Ex outputted from the device 10A. In other words, when display control devices are employed, internal registers thereof are set by the computer system 100 so that the display control device 10A operates as the master and the display control device 10B operates as the slave. Thus, one display control device 10A operates as master and the other display control device 10B as slave, and the device 10B reliably follows the device 10A, in synchronization therewith.

Figure 4:
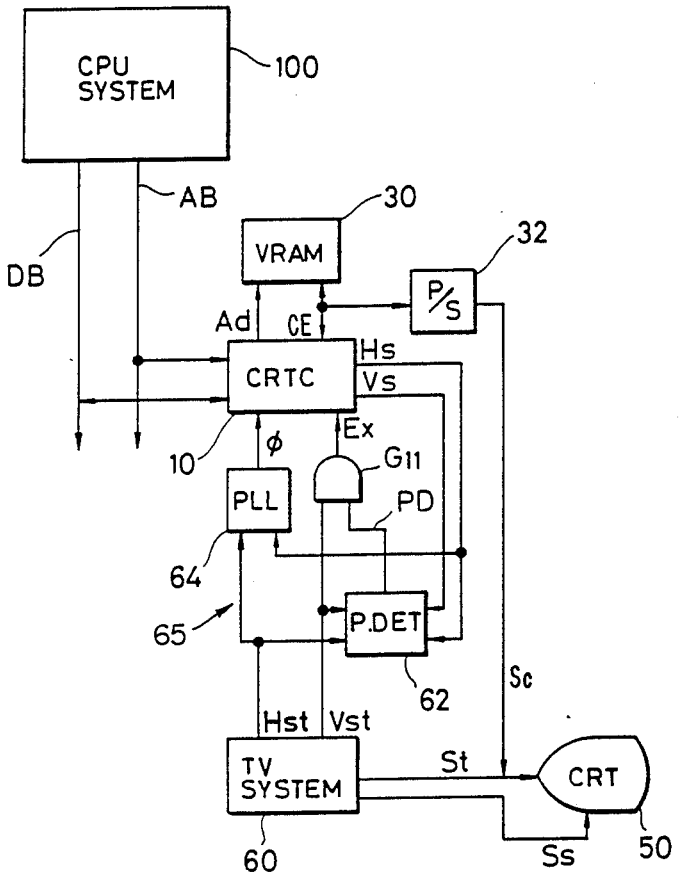
FIG. 4 is a schematic diagram of another embodiment of the present invention.

FIG. 4 shows another embodiment of the present invention. The embodiment shown in this figure uses the display control device 10 described above, and is constructed so that image data St to be displayed on a display system, such as a television system 60 which has the separate synchronizing signal system, and image data Sc controlled by the display control device 10 can be superposed for display in one CRT display device 50 while the mutual prescribed positional relationship thereof is maintained.

In order to display the image data stored in the memory 30 on a display device of an interlace scanning type whose image display is formed of horizontal scanning lines and forming successive frames, i.e. a conventional CRT display device 50 in this case, the display control device 10 is provided with a scanning counter which is incremented at a period based on the timing of access to a memory 30 and whose count content circulates periodically. The display control device 10 is constructed so that the memory 30 is accessed by address data Ad produced on the basis of the count of the scanning counter, as already described. Horizontal and vertical synchronizing signals are also produced on the basis of the count of this scanning counter.

The television 60 causes the CRT display device 50 to display the image data St of the television system 60 side, using a synchronizing signal Ss which is prepared separately in the conventional manner.

The display control device 10 is employed together with a basic clock generation circuit 65 constructed by using a phase-difference detection circuit 62, an AND gate G11, and a PLL (phase locked loop) 64.

The basic clock generation circuit 65 prepares a basic clock $\phi$ for the display control device 10 based on a horizontal synchronizing signal Hst outputted from the television system 60. The display control device 10 produces an access control signal CE for the memory 30, address data Ad, and the vertical synchronizing signal Vs and horizontal synchronizing signal Hs from the basic clock $\phi$.

Figure 5:
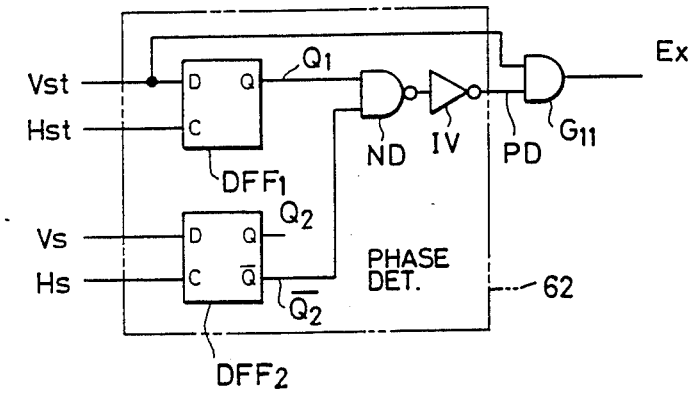
FIG. 5 is a schematic circuit diagram of the phase detector in the embodiment of FIG. 4.

The phase-difference detection circuit 62 detects any phase difference between the vertical synchronizing signal Vs outputted from the display control device 10 and the vertical synchronizing signal Vst outputted from the television system 60. The phase detector 62 comprises flip-flops $DFF_1$, $DFF_2$, a NAND circuit ND and an inverter IV, as shown in FIG. 5. The $DFF_1$ is employed for detecting the phase difference between the external vertical synchronizing signal Vst and the external horizontal synchronizing signal Hst. At the even field, the leading edge (time: t2) is preceded by a half period of the horizontal scanning period to that of the horizontal synchronizing signal Hst (time: t3), as shown in FIGS. 6A and 6B. On the other hand, at the odd field, the leading edge of the signal Vs and the leading edge of the signal Hst (time: t6) are coincident with each other.

The flip-flop $DFF_1$ receives the signal Vst and Hst at a data input terminal D and a clock input terminal C, respectively. Therefore, the leading edge (t3) of the output $Q_1$ of the flip-flop $DFF_1$ is delayed by half period with respect to the signal Vst at the even field as shown in the FIG. 6C. On the other hand, at the odd field, the leading edge of the signal $Q_2$ and the leading edge of the signal Vst are coincident with each other.

Figure 6:
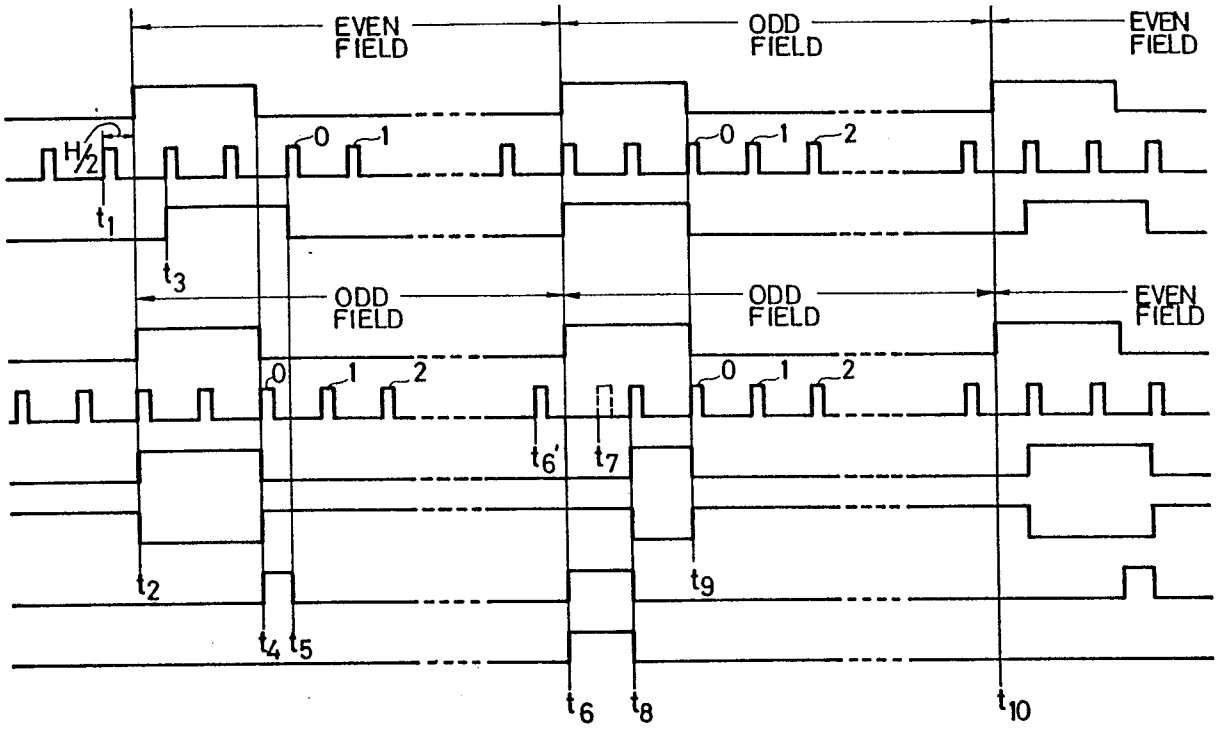
FIGS. 6 and 7 are timing charts of the operation of the circuit of FIG. 5.

The operation of the flip-flop $DFF_2$ is the same as that of the flip-flop $DFF_1$. The timing chart for the flip-flop $DFF_2$ is shown at FIGS. 6D to 6G. When the time period t2 to t6 represents an even field to the TV system 60 and an odd field to the CRTC 10, as shown in FIG. 6, the output $\overline{Q_2}$ becomes high at the time t4 and the output $Q_1$ becomes low at the time t5. In accordance with this, an output of the inverter IV becomes high during the period t4 to t5. In this case, the output Ex of the AND circuit $G_{11}$ is held to the low level, as shown in FIG. 61, since the external signal Vst falls to the low level at the time t4.

At time t6, the output PD of the inverter IV is raised to the high level again since the output $Q_1$ is raised at the time t6 to the high level and the output $\overline{Q_2}$ is held to the high level. Since, at the time t6, the external signal Vst is raised to the high level, the signal Ex is raised to the high level. According with this, the counters $C_0$ to $C_2$ and the flip-flop FDFF (FIG. 1) are reset to their initial state. The initial state of the flip-flop FDFF means the odd field. Thus, the odd field of the CRTC 10 is synchronized with that of the TV system 60 at time t6.

In accordance with the resetting operation, the horizontal synchronizing signal Hs is raised to the high level (t8) after one horizontal scanning period H to the time t6 (not at time t7 delayed one period H to the time t6'). Since the output $\overline{Q_2}$ of the flip-flop $DFF_2$ falls at time t8 to the low level, the output Ex falls to the low level. When the odd or even field of the CRTC 10 is synchronized with the odd or even field of the TV system 60, the output Ex is held at the low level, as shown in FIG. 6I.

Figure 7:
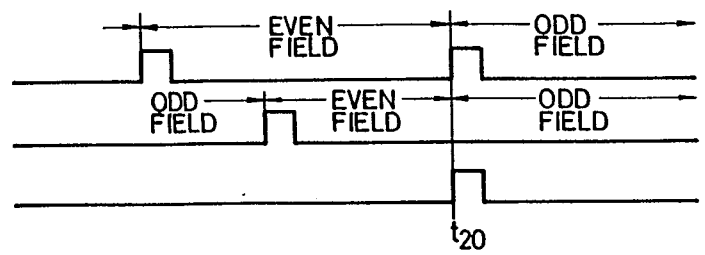

In the case where the phase difference between the Vst and Vs is large, as shown in FIG. 7, the output Ex is raised to the high level in synchronization with the signal Vst of the odd field. Therefore, the counters and flip-flop of the CRTC 10 are reset to their initial state at time t20.

As shown in FIG. 6, the phase-difference detection circuit 62 detects the phases of the vertical synchronizing signal Vs outputted from the display control device 10 and the vertical synchronizing signal Vst outputted from the television system 60, while comparing the relationships between the vertical synchronizing signals. (Whether the vertical synchronizing signals are odd-numbered or even-numbered is detected and a comparison is performed.) By taking the logical "and" product of the detection output of the phase-difference detection circuit 62 and the vertical synchronizing signal Vs outputted from the display control device 10, using the AND gate G11, a pulse output synchronous with the vertical synchronizing signal Vst can be obtained. This pulse output is inputted as the external synchronizing signal Ex to the display control device 10 so that the initialization timing of the count of each counter in the display control device 10 can be synchronized periodically with the odd-numbered (or even-numbered) vertical synchronizing signals on the television system side. Incidentally, the display control device 10 in this case is set beforehand so as to operate as the slave by an instruction given by the computer system 100, for example.

In this way, the image data St displayed in the display system which has a separate synchronizing signal system, like the television system 60, and the image data Sc controlled by the display control device 10 can be superposed for display on one image display screen with the prescribed mutual positional relationship thereof maintained.

As can be seen from the foregoing description, by applying a construction in which a memory is accessed by address data prepared on the basis of a count of a scanning counter, and horizontal and vertical synchronizing signals are each generated on the basis of the count of this scanning counter, the count of the scanning counter being initialized periodically to a prescribed value by a signal inputted from external equipment, a plurality of image data items controlled by each of a plurality of CRTCs can be superposed for display on one image display screen, with the prescribed mutual positional relationships thereof maintained.

By applying a construction in which a memory is accessed by address data prepared on the basis of a count of a scanning counter, and horizontal and vertical synchronizing signals are each generated on the basis of the count of this scanning counter, while a signal synchronous with either the odd-numbered or the even-numbered vertical synchronizing signals is outputted to external equipment, a plurality of image data items controlled by each of a plurality of CRTCs can be superposed for display on a display device of an interlace scanning system, with the prescribed mutual positional relationships thereof maintained.

Further, by applying a construction in which a memory is accessed by address data prepared on the basis of a count of a scanning counter horizontal and vertical synchronizing signals are given by a display system of an interlace scanning type which has a separate synchronizing signal system, and a clock signal determining the timing of access to the memory is prepared on the basis of the horizontal synchronizing signal, while either the odd-numbered or the even-numbered vertical synchronizing signals are detected from the vertical synchronizing signal and the count of the scanning counter is initialized forcibly to a prescribed value on the basis of the signals thus detected, image data displayed on the display system with the separate synchronizing signal system, like a television system, and image data controlled by a CRTC can be superposed for display on one image display screen with a prescribed mutual positional relationship maintained.

The effects described above enable the attainment of a synergistic effect in that a plurality of images can be synthesized into a complicated image or a wide variety of images in a simple manner and at high speed.

The above is a detailed description of the invention based on various embodiments thereof. This invention is not limited to these embodiments, of course, it can be varied in many ways within its fundamental scope. For instance, a liquid-crystal display device or a plasma display device can be used as the CRT display device, and the period of the external synchronizing signal Ex can be set to be several frames long, or any longer length of time.

The invention has been described above mainly in relation to the case in which it is adapted to the technique of synchronizing a display control device of a CRT display device, which is used as the background of the field of application thereof. The present invention is not limited to this application, it can be applied, for instance, to the technique of synchronizing a display control device which has an intelligent processing function which decides the content of image data and rewrites it. The present invention can be applied to any devices in which at least synchronization or alignment is a necessary condition.

We claim:

1. A system including memory means for storing image data, a central processing unit coupled to said memory means and a display system coupled to said central processing unit and said memory means, wherein said central processing unit controls said display system and supplied image data to said memory means and wherein said display system displays image data stored in said memory means on a display device as an image display formed of horizontal scanning lines with a preselected timing, said display system comprising:

means, including at least first and second display control devices, for accessing said memory means to read out said image data, each of said first and second display control devices including (a) scanning counter means, incremented at a rate based on a required timing of access to said memory means, for generating a count which is repeated in accordance with said preselected timing, (b) address generating means, responsive to said scanning counter means, for generating sequential addresses for accessing said memory means, (c) timing signal generator means, responsive to said scanning counter means, for generating a horizontal synchronizing signal and a vertical synchronizing signal based on said count, wherein said timing signal generator means includes means for discriminating between an odd-numbered display field and an even-numbered display field so that said timing signal generating means provides interlace scanning, (d) synchronizing signal generator means, responsive to said timing signal generator means, for generating a periodic synchronizing signal, (e) control terminal means for transmitting said periodic synchronizing signal to or receiving a periodic synchronizing signal from another of said display control devices, (f) switching means for connecting said control terminal means either to said synchronizing signal generator means for sending out said periodic synchronizing signal or to said scanning counter means and said discriminating means so that a periodic initialization of said scanning counter means is effected and said discriminating means is periodically set to a predetermined state in response to an externally received periodic synchronizing signal;

display means connected to said memory means for displaying image data read out of said memory means in response to said first and second display control devices, respectively, as superimposed images with identical timing; and synchronizing control means for connecting the control terminal means of said first display control device to the control terminal means of said second display control device, so that said periodic synchronizing signal generated in one of said first and second display control devices may be applied to the other of said first and second display control devices.

2. A display control device for accessing a memory to read out image data to be displayed on an image device in an image display scanning system in which an image display is formed of horizontal scanning lines with a preselected timing, comprising:

scanning counter means incremented at a rate based on a required timing of access to said memory for generating a count which is repeated in accordance with the preselected timing of said image display scanning system;

address generating means responsive to said scanning counter means for generating sequential addresses for accessing said memory;

timing signal generator means responsive to said scanning counter means for generating a horizontal synchronizing signal and a vertical synchronizing signal based on said count, wherein said timing signal generator means includes means for discriminating between an odd-numbered display field and an even-numbered display field so that said timing signal generating means provides interlace scanning, wherein said scanning counter means includes a first counter driven by a clock signal having a frequency based on said required timing of access to said memory so as to produce an output to said timing signal generator means for generating said horizontal synchronizing signal, and a second counter driven by a signal corresponding to said horizontal synchronizing signal so as to produce an output to said timing signal generator means for generating said vertical synchronizing signal, and wherein said timing signal generator means further includes means for comparing the output of said first counter to a first preselected value and for resetting said first counter when a match is detected and means for comparing the output of said second counter to a second preselected value and for resetting said second counter when a match is detected;

synchronizing signal generator means responsive to said timing signal generator means for generating as internal periodic synchronizing signal;

control terminal means for transmitting or receiving said internal periodic synchronizing signal or an external periodic synchronizing signal respectively;

switching means for connecting said control terminal means either to said synchronizing signal generator means for sending out said internal periodic synchronizing signal or to said scanning counter means and said discriminating means so that a periodic initialization of said scanning counter means is effected and said discriminating means is periodically set to a predetermined state in response to a received external periodic synchronizing signal;

data storing means coupled to said timing signal generator means and to data terminals to be coupled to a data bus line for storing data, and including first register means for storing data representing said first preselected value and second register means for storing data representing said second preselected value; and address register means, coupled to said data storing means and to said data terminals, for storing selection data provided from said data terminals, and for indicating one of said first and second register means in accordance with the stored selection data such that predetermined data from said data bus line is stored in said register means indicated by said stored selection data.

3. A display control device according to claim 2, wherein said data storing means further includes third register means for storing control data for controlling said switching means, and said address register means stores selection data for indicating one of said first, second and third register means, whereby predetermined data from said bus line is stored in said selected register means.

4. A display control device according to claim 3, wherein said synchronizing signal generator means includes gate means for generating said internal periodic synchronizing signal in response to a predetermined state of said discriminating means.

5. A display control device according to claim 4, wherein said gate means is coupled to said timing signal generator means and to said discriminating means and generates said internal periodic synchronizing signal in time with said vertical signal.

6. A system including memory means for storing image data, a central processing unit coupled to said memory means and a display system coupled to said central processing unit and said memory means, wherein said central processing unit controls said display system and supplies image data to said memory means, and wherein said display system displays image data stored in said memory means on a display device as an image display formed of horizontal scanning lines with a preselected timing, said display system comprising:

means including at least first and second display control devices for accessing said memory means to read out said image data, each of said first and second display control devices including (a) scanning counter means, incremented at a rate based on a required timing of access to said memory means, for generating a count which is repeated in accordance with the preselected timing of said display system, (b) address generating means responsive to said scanning counter means for generating sequential address for accessing said memory means, (c) timing signal generator means responsive to said scanning counter means for generating a horizontal synchronizing signal and a vertical synchronizing signal based on said count, wherein said timing signal generator means includes means for discriminating between an odd-numbered display field and an even-numbered display field so that said timing signal generating means provides interlace scanning, wherein said scanning counter means includes a first counter driven by a clock signal having a frequency based on said required timing of access to said memory means so as to produce an output to said timing signal generator means for generating said horizontal synchronizing signal, and a second counter, driven by a signal corresponding to said horizontal synchronizing signal so as to produce an output to said timing signal generator means, for generating said vertical synchronizing signal, and wherein said timing signal generator means further includes means for comparing the output of said first counter to a first preselected value and for resetting said first counter when a match is detected, and means for comparing the output of said second counter to a second preselected value and for resetting said second counter when a match is detected, (d) synchronizing signal generator means, responsive to said timing signal generator means, for generating an internal periodic synchronizing signal, (e) control terminal means for transmitting or receiving said internal periodic synchronizing signal or an external periodic synchronizing signal respectively, (f) switching means for connecting said control terminal means either to said synchronizing signal generator means for sending out said internal periodic synchronizing signal or to said scanning counter means and said discriminating means so that a periodic initialization of said scanning counter means is effected and said discriminating means is periodically set to a predetermined state in response to a received external periodic synchronizing signal, (g) data storing means coupled to said timing signal generator means and to data terminals to be coupled to said central processing unit for storing data, and including first register means for storing data representing said first preselected value and second register means for storing data representing said second preselected value, (h) address register means coupled to said data storing means and to said data terminals for storing selection data provided from said central processing unit, and for indicating one of said first and second register means in accordance with the stored selection data such that predetermined data from said central processing unit is stored in said register means indicated by said stored selection data;

display means connected to said memory means for displaying image data read out of said memory means in response to said first and second display control devices, respectively, as superimposed images with identical timing; and synchronizing control means for connecting said control terminal means of said first display control device to said control terminal means of said second display control device, so that said periodic synchronizing signal generated in one of said first and second display control device may be applied to the other of said first and second display control devices.

7. A system according to claim 6, wherein said data storing means further includes third register means for storing control data for controlling said switching means, and said address register means stores selection data for indicating one of said first, second and third register means, whereby predetermined data is stored in the selected register means by said central processing unit.

8. A system according to claim 7, wherein said synchronizing signal generator means includes gate means for generating said internal periodic synchronizing signal in response to a predetermined state of said discriminating means.

9. A system according to claim 8, wherein said gate means is coupled to said timing signal generator means and to said discriminating means and generates said internal periodic synchronizing signal in time with said vertical synchronizing signal.

* * * * *